US008714929B2

(12) United States Patent
Joshi et al.

(10) Patent No.: US 8,714,929 B2
(45) Date of Patent: May 6, 2014

(54) TURBINE ASSEMBLY AND METHOD FOR SECURING A CLOSURE BUCKET

(75) Inventors: Manish Joshi, Karnataka (IN); Vivekanandhan Thiruvettipuram Madhivanan, Karnataka (IN)

(73) Assignee: General Electric Company, Schenectady, NY (US)

( * ) Notice: Subject to any disclaimer, the term of this patent is extended or adjusted under 35 U.S.C. 154(b) by 814 days.

(21) Appl. No.: 12/943,485

(22) Filed: Nov. 10, 2010

(65) Prior Publication Data

US 2012/0114490 A1 May 10, 2012

(51) Int. Cl.
*F01D 5/32* (2006.01)

(52) U.S. Cl.
USPC ..... 416/218; 416/220 R

(58) Field of Classification Search
USPC ..... 416/215, 216, 219 R, 220 R, 221 R, 416/204 A, 221, 218
See application file for complete search history.

(56) References Cited

U.S. PATENT DOCUMENTS

| | | | | | |
|---|---|---|---|---|---|
| 1,687,891 | A | * | 10/1928 | Ray | 416/216 |
| 3,000,614 | A | * | 9/1961 | Welsh | 416/221 |
| 3,073,569 | A | * | 1/1963 | Wagner | 416/204 R |
| 3,088,708 | A | * | 5/1963 | Feinberg | 416/215 |
| 3,165,294 | A | * | 1/1965 | Anderson | 416/220 R |
| 3,721,506 | A | * | 3/1973 | Anderson | 416/215 |
| 3,826,592 | A | | 7/1974 | Raboin | |
| 3,904,317 | A | * | 9/1975 | Cardin et al. | 416/220 R |
| 3,954,350 | A | * | 5/1976 | Zahring | 416/215 |
| 3,955,898 | A | * | 5/1976 | Zaehring | 416/215 |
| 4,432,697 | A | * | 2/1984 | Miura et al. | 416/198 A |
| 4,676,723 | A | * | 6/1987 | Kiger et al. | 416/221 |
| 4,702,673 | A | * | 10/1987 | Hansen et al. | 416/215 |
| 4,915,587 | A | | 4/1990 | Pisz et al. | |
| H1258 | H | * | 12/1993 | Hindle, Jr. | 416/215 |
| 5,482,417 | A | * | 1/1996 | Erickson | 411/306 |
| 5,720,596 | A | * | 2/1998 | Pepperman | 416/220 R |
| 6,030,178 | A | | 2/2000 | Caruso | |
| 6,428,279 | B1 | | 8/2002 | Reluzco et al. | |
| 6,499,959 | B1 | | 12/2002 | Reluzco et al. | |
| 6,755,618 | B2 | | 6/2004 | Munshi et al. | |
| 7,517,195 | B2 | | 4/2009 | Caruso et al. | |
| 2006/0018756 | A1 | * | 1/2006 | Schroder | 416/219 R |
| 2007/0014667 | A1 | * | 1/2007 | Pickens et al. | 416/193 A |
| 2009/0047128 | A1 | | 2/2009 | Bracken et al. | |
| 2009/0220345 | A1 | | 9/2009 | Krutzfeldt et al. | |

FOREIGN PATENT DOCUMENTS

| | | | |
|---|---|---|---|
| EP | 1882083 | B1 | 7/2009 |
| WO | WO2006104451 | A1 | 10/2006 |

* cited by examiner

*Primary Examiner* — Edward Landrum
*Assistant Examiner* — Joshua R Beebe
(74) *Attorney, Agent, or Firm* — Cantor Colburn LLP

(57) ABSTRACT

According to one aspect of the invention, a turbine assembly is provided, wherein the turbine assembly includes a drum rotor comprising a slot and a closure bucket configured to be placed in the slot, the closure bucket including a lock pin disposed in a base member of the closure bucket. In addition, a portion of the lock pin is configured to rotatably extend into a cavity in the slot thereby securing the closure bucket within the slot.

19 Claims, 3 Drawing Sheets

TURBINE ASSEMBLY AND METHOD FOR SECURING A CLOSURE BUCKET

BACKGROUND OF THE INVENTION

The subject matter disclosed herein relates to steam turbines. More particularly, the subject matter relates to securing a closure bucket to a drum rotor in a steam turbine.

Steam turbine buckets, or blades, are often designed for installation on a turbine rotor wheel in a tangential direction. The buckets are typically attached to the turbine wheel using external circumferential dovetails, with a male dovetail on the wheel periphery and a complimentary female dovetail in the base or root of the bucket. In order to load these buckets onto the wheel, a notch which locally removes the male dovetail portions is cut on the periphery of the wheel, leaving a generally rectangular opening in the rotor wheel. Each bucket is then initially placed in the opening and then displaced tangentially onto and around the wheel. Once all the buckets have been loaded, a closure bucket (or "final bucket") is placed in the opening, wherein grub screws are inserted through the rotor wheel to engage the closure bucket, thereby securing the closure bucket in the rotor wheel. The process of inserting grub screws and tapping threads to receive the screws is time consuming. In addition, the screws and threads are destroyed in situations where the closure bucket, or other buckets disposed on the rotor, need to be removed for maintenance. Thus, the grub screws can lead to challenging, costly, and time consuming assembly, repair, and reassembly of the rotor.

BRIEF DESCRIPTION OF THE INVENTION

According to one aspect of the invention, a turbine assembly is provided, wherein the turbine assembly includes a drum rotor comprising a slot and a closure bucket configured to be placed in the slot, the closure bucket including a lock pin disposed in a base member of the closure bucket. In addition, a portion of the lock pin is configured to rotatably extend into a cavity in the rotor thereby securing the closure bucket within the slot.

According to another aspect of the invention, a method for securing a closure bucket in a drum rotor is provided, the method including receiving the closure bucket within a slot of the drum rotor. The method further includes rotating a lock pin disposed in a recess of the closure bucket, wherein rotating causes a portion of the lock pin to extend into a cavity in the slot, thereby securing the closure bucket within the slot.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
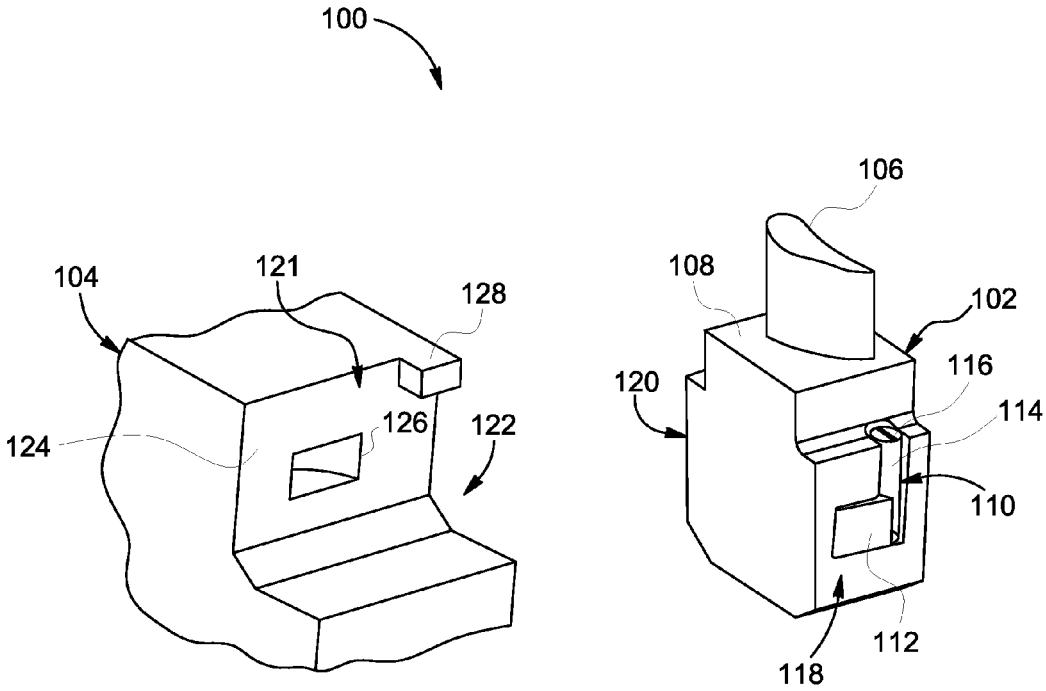
FIG. 1 is a perspective view of an embodiment of a closure bucket assembly.

FIG. 1 is a perspective view of an embodiment of a closure bucket assembly 100. The closure bucket assembly 100 includes a closure bucket 102 received by a portion of a drum rotor 104. The closure bucket 102 includes an airfoil 106 positioned on a base member 108. A lock pin 110 is rotatably disposed on at least one side of the closure bucket 102. The lock pin 110 comprises a protrusion 112 extending from a shaft 114, wherein a driver head 116 is located on an end of the shaft 114. As depicted, the lock pin 110 is disposed in trailing edge side 118 of the closure bucket 102. Another lock pin, similar to lock pin 110, can also disposed in leading edge side 120 of the closure bucket.

In the depicted embodiment, a portion of the drum rotor 104 includes opening 121 of a slot 122 configured to radially receive a plurality of buckets, including closure bucket 102. As illustrated, the sectional view of the drum rotor 104 shows approximately one half of the rotor slot 122, wherein the section has been taken along the drum rotor wheel radially and tangentially. The drum rotor 104 includes a surface of a leading edge 124 configured to mate to the leading edge 120 of the closure bucket 102. The leading edge 124 includes a lock pin cavity 126 configured to receive a portion of a lock pin extending from the leading edge 120. As described in detail below with reference to FIG. 3, lock pins 110 may be disposed on opposite sides of base member 108, such as trailing edge side 118 and leading edge side 120, wherein portions of the lock pins extend into cavities 126 in the slot 122, thereby securing the closure bucket 102 in the slot 122. By securing the closure bucket 102 in the slot 122, load is transferred from the airfoil 106 to the drum rotor 104 to turn the rotor within the turbine. Buckets installed prior to the closure bucket 102 are disposed about the drum rotor 104 wherein a male dovetail 128 mates to a female dovetail of each bucket, thereby enabling each bucket to transfer loads to the drum rotor 104. Therefore, the depicted closure bucket 102 is secured via the lock pin 110 within the opening 121 of slot 122, where there is no male dovetail 128 to retain the closure bucket 102. In other embodiments, closure bucket 102 includes the base member 108 without an airfoil.

Figure 2:
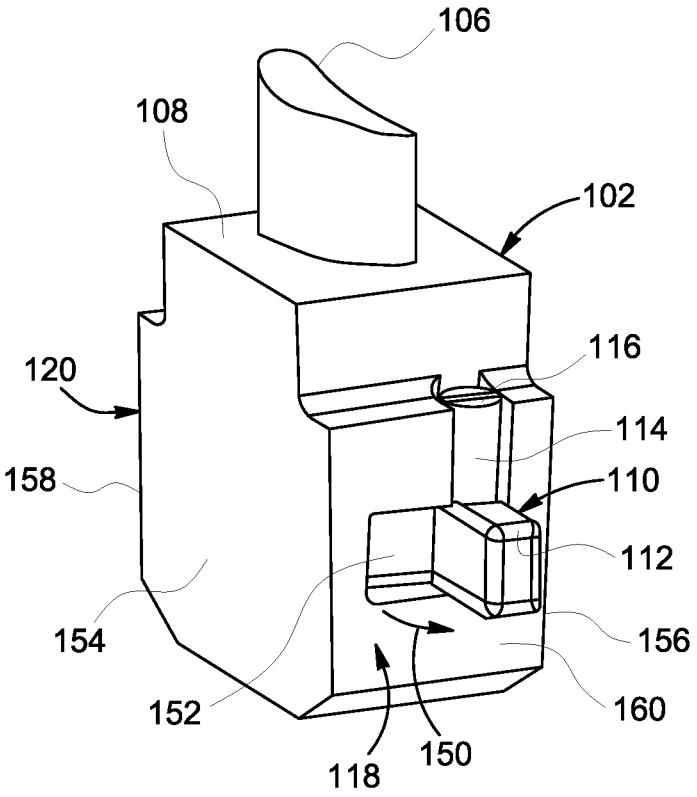
FIG. 2 is a perspective view of an embodiment of a closure bucket, including a lock pin extending from the closure bucket.

FIG. 2 is a perspective view of the closure bucket 102 shown in FIG. 1, wherein the lock pin 110 is in an extended position from the trailing edge side 118 of closure bucket 102. The lock pin 110 is rotatably or pivotally disposed in the trailing edge 118 side of the closure bucket 102 and may rotate or extend in direction 150 from a recess 152 to the extended position. In an embodiment, a second rotatably disposed lock pin (not shown) is also disposed within a recess on trailing edge 120 surface 158. As depicted in FIG. 1, the closure bucket 102 is installed in opening 121 with the lock pin 110 positioned within recess 152 and substantially flush with trailing edge 118 surface 160. The closure bucket 102 is the final bucket installed on the drum rotor 104 and is placed between adjacent buckets in slot 122, wherein surfaces 154 and 156 are mated to or in contact with each adjacent bucket. To lock or secure the closure bucket 102 in place, the lock pin 110 is rotated approximately 90 degrees, where the protrusion 112 is positioned within the adjacent rotor slot recess.

The lock pin 110 may be any suitable shape that is flush within a recess 152 and rotatably engages a cavity 126. In embodiments, the lock pin 110 has one or more protrusions that are moved to engage one or more cavities located in a drum rotor. The closure bucket 102 may be formed from a high strength, durable material, such as a steel alloy or stainless steel. The lock pin 110 material can be stainless steel or nickel based alloy. The parts of the closure bucket 102 may be formed and/or coupled by a suitable process, such as casting, welding, machining, or any combination thereof or including one or more of the foregoing. As depicted, the cavity 126 is an arcuate cavity formed in a side of rotor slot 122. In the exemplary embodiment, the arrangement of the lock pin 110, closure bucket 102, and drum rotor 104 enables improved manufacturing by eliminating grub screws, tapping, and drilling used in other embodiments. In addition, during repair or reconditioning of buckets, the closure bucket 102 may be removed without damaging the drum rotor 104 or closure bucket 102, thereby providing simplified, in situ repair, and reassembly of the components.

Figure 3:
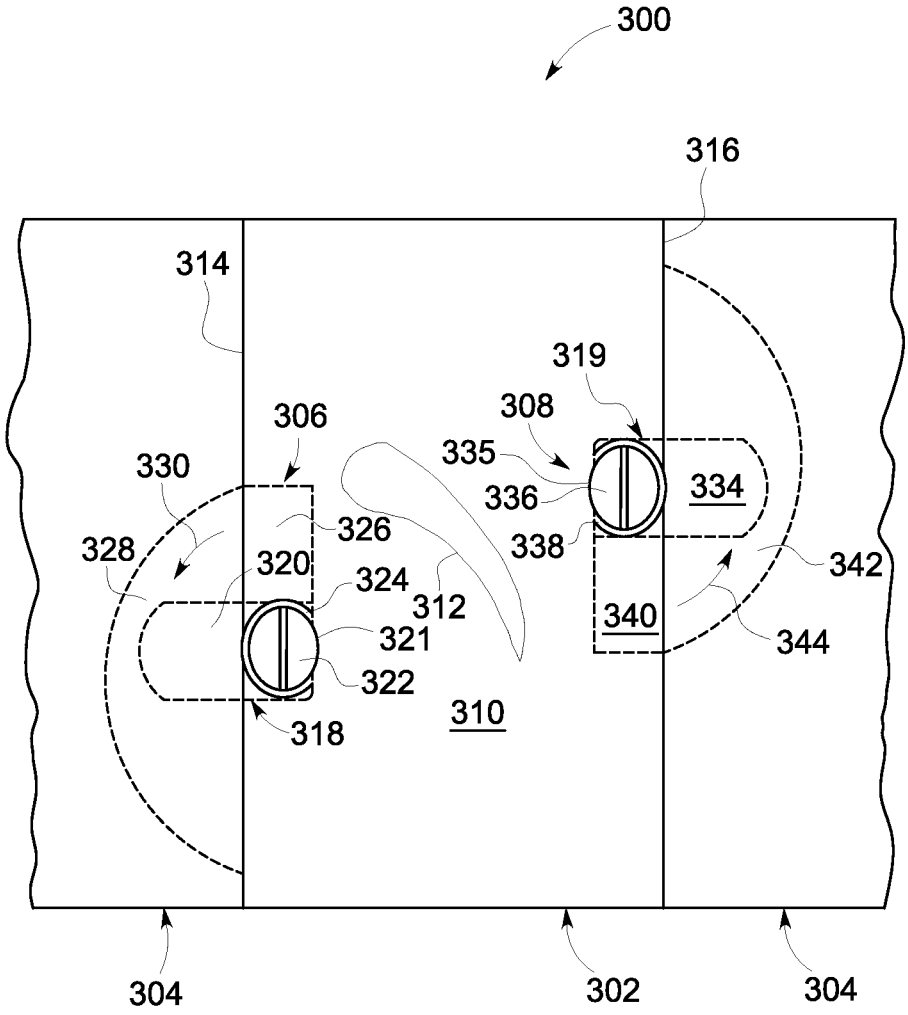
FIG. 3 is a top view of an embodiment of a closure bucket assembly.

FIG. 3 is a top view of an embodiment of a closure bucket assembly 300. The closure bucket assembly 300 includes a closure bucket 302 positioned in a drum rotor 304. The closure bucket assembly 300 further includes locking mechanisms 306 and 308 configured to lock the closure bucket 302 in the drum rotor 304. The closure bucket 302 includes a base member 310, airfoil 312, leading edge side 314, trailing edge side 316, lock pin 318, and lock pin 319. Lock pin 318 is located on the leading edge side 314 of base member 310 and extends into drum rotor 304. The lock pin 318 comprises a protrusion 320, shaft 321, and driver head 322. An anti-rotation device 324, such as a D-shaped nut, is disposed on the locking pin shaft 321, thereby preventing rotation of the lock pin 318 from a selected position, such as the extended position. The lock pin 318 is in a retracted position within a recess 326 during installation and extends into cavity 328 of the drum rotor 304, as shown by arrow 330. Similarly, the lock pin 319, located on trailing edge side 316, comprises a protrusion 334, shaft 335, and driver head 336. An anti-rotation device 338 is disposed on the locking pin shaft 335, thereby preventing rotation of the lock pin 319 from a selected position (e.g., the extended position). After insertion within the rotor slot, the lock pin 319 extends from a retracted position within recess 340 into cavity 342 of the drum rotor 304, as shown by arrow 344.

The exemplary embodiment of the closure bucket assembly 300 provides two locking mechanisms 306 and 308. The locking mechanisms 306 and 308 enable a portion of the lock pins 318 and 319, such as protrusions 320 and 334, to engage the drum rotor 304 by rotatably protruding into recesses 328 and 342, respectively. As depicted, lock pins 318 and 319 are positioned in the leading edge side 314 and trailing edge side 316, respectively, of base member 310. The lock pins 318 and 319 are locked or secured in a selected rotational position by anti-rotation devices 324 and 338, respectively, thereby securing the closure bucket 302 within a slot of drum rotor 304. The anti-rotation devices 324 and 338 may be any suitable devices to prevent rotation of the lock pins 318 and 319 from selected positions, such as the extended position. Non-limiting examples of anti-rotation devices include D-shaped nuts, anti-rotation tabs, and staking. As depicted, the driver heads 322 and 336 are contacted and engaged by a tool, such as a flat edge screwdriver, to cause rotation of the lock pins 318 and 319. Accordingly, embodiments of the closure bucket assembly 300 provide a simple mechanism for locking or securing the closure bucket 302 in the drum rotor 304, thereby transferring a load from the airfoil 312 to the drum rotor 304. The arrangement also provides a simplified assembly to improve the manufacturing and repair processes. For example, the closure bucket 302 is removed for repair by pivoting or rotating the lock pins 318 and 319 via driver heads 322 and 336, respectively. This arrangement enables in situ removal, repair, and replacement of the closure bucket without drilling, tapping, or other time consuming processes.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An assembly comprising:

a drum rotor comprising a slot; and a closure bucket configured to be placed in the slot, the closure bucket comprising a lock pin disposed in a base member of the closure bucket, wherein a portion of the lock pin comprises a protrusion configured to rotatably extend into a cavity in the slot thereby securing the closure bucket within the slot, the lock pin being retained at leading or trailing sides of the base member in an L-shaped slot having a radially oriented slot portion configured to permit rotation of the lock pin about a rotational axis and a circumferential slot portion configured to interfere with the protrusion to prevent lock pin rotation in a non-locking direction.

2. The assembly of claim 1, wherein the lock pin comprises a shaft coupled to a driver head, the driver head configured to rotate in place, causing the portion of the lock pin to extend into the cavity.

3. The assembly of claim 1, wherein the lock pin comprises an anti-rotation device to secure the lock pin in a selected position.

4. The assembly of claim 1, wherein the closure bucket comprises an airfoil disposed on the base member.

5. The assembly of claim 1, wherein the base member comprises the L-shaped recess configured to retain the lock pin during insertion of the closure bucket into the slot.

6. The assembly of claim 1, wherein the cavity comprises an arcuate cavity in a surface of the slot.

7. The assembly of claim 1, wherein the lock pin comprises a shaft and the protrusion configured to extend into the cavity, wherein the lock pin is configured to allow removal of the closure bucket from the slot by rotating the shaft in a selected direction.

8. A method for securing a closure bucket in a drum rotor comprising:

receiving the closure bucket within a slot of the drum rotor; and rotating a lock pin disposed in a recess of the closure bucket, wherein rotating comprises extending a portion of the lock pin comprising a protrusion into a cavity in the slot, thereby securing the closure bucket within the slot, the method further comprising:

retaining the lock sin in an L-shared slot at leading or trailing sides of a base member of the closure bucket; and forming the L-shaped slot to have a radially oriented slot portion configured to permit rotation of the lock pin about a rotational axis and a circumferential slot portion configured to interfere with the protrusion to prevent lock pin rotation in a non-locking direction.

9. The method of claim 8, comprising rotating a second lock pin disposed in a second recess of the closure bucket, wherein rotating the second lock pin comprises extending a protrusion of the second lock pin into a second cavity of the slot.

10. The method of claim 8, wherein rotating the lock pin comprises contacting a driver head coupled to a shaft of the lock pin, wherein contacting comprises pivoting the driver head to cause the portion of the lock pin to extend into the cavity.

11. The method of claim 8, wherein rotating the lock pin comprises securing the lock pin in a selected position via an anti-rotation device.

12. The method of claim 8, wherein the closure bucket comprises an airfoil disposed on the base member.

13. The method of claim 12, wherein receiving the closure bucket within the slot comprises retaining the lock pin in the L-shaped recess of the base member.

14. The method of claim 8, wherein the lock pin is configured to allow removal of the closure bucket from the slot by rotating the lock pin in a selected direction.

15. A closure bucket comprising:

a base member an airfoil disposed on the base member; and a lock pin rotatably disposed in the base member, wherein a portion of the lock pin comprises a protrusion configured to extend to secure the closure bucket within a drum rotor slot, the lock pin being retained at leading or trailing sides of the base member in an L-shaped slot having a radially oriented slot portion configured to permit rotation of the lock pin about a rotational axis and a circumferential slot portion configured to interfere with the protrusion to prevent lock pin rotation in a non-locking direction.

16. The closure bucket of claim 15, wherein the lock pin comprises a shaft coupled to a driver head and the protrusion configured to rotatably extend into a cavity of the slot as the driver head pivots.

17. The closure bucket of claim 15, wherein the base member comprises the L-shaped recess configured to retain the lock pin during insertion of the closure bucket into the drum rotor slot.

18. The closure bucket of claim 15, wherein the lock pin is disposed on a first side of the base member and a second lock pin is disposed on a side opposite the first side, wherein a portion of the second lock pin is configured to rotatably extend.

19. The closure bucket of claim 15, wherein the lock pin comprises a shaft and the protrusion configured to extend, wherein the lock pin is configured to allow removal of the closure bucket from the drum rotor slot by rotating the shaft in a selected direction.

* * * * *